US008151716B2

(12) United States Patent
Harned et al.

(10) Patent No.: US 8,151,716 B2
(45) Date of Patent: Apr. 10, 2012

(54) FEED INJECTOR COOLING APPARATUS AND METHOD OF ASSEMBLY

(75) Inventors: Monty Lee Harned, Sugarland, TX (US); Sunilkant A. Patel, Sugarland, TX (US); Salvatore Bernard Vasi, Rocky Point, NY (US)

(73) Assignee: General Electric Company, Schenectady, NY (US)

( * ) Notice: Subject to any disclaimer, the term of this patent is extended or adjusted under 35 U.S.C. 154(b) by 944 days.

(21) Appl. No.: 11/854,970

(22) Filed: Sep. 13, 2007

(65) Prior Publication Data

US 2009/0074638 A1 Mar. 19, 2009

(51) Int. Cl.
*F23D 1/00* (2006.01)
*F23G 5/027* (2006.01)

(52) U.S. Cl. ..... 110/263; 110/229; 431/160; 239/132.3

(58) Field of Classification Search ..... 110/229, 110/101 R, 344; 422/305; 29/890.035, 890.036; 60/39.83, 722; 431/144, 160, 154, 364, 142, 431/159, 195; 48/86 R, 197 R; 239/132.3, 239/132.1, 132.5; 588/300; 415/175
See application file for complete search history.

(56) References Cited

U.S. PATENT DOCUMENTS

| | | | | |
|---|---|---|---|---|
| 1,337,328 | A * | 4/1920 | Said | 432/226 |
| 3,173,499 | A * | 3/1965 | Ross | 431/158 |
| 3,696,795 | A | 10/1972 | Smith et al. | |
| 3,802,193 | A | 4/1974 | Wong | |
| 3,945,353 | A | 3/1976 | Dreisin | |
| 4,057,021 | A * | 11/1977 | Schoppe | 110/264 |
| 4,229,944 | A | 10/1980 | Weiler | |
| 4,752,303 | A * | 6/1988 | Materne et al. | 48/202 |
| 4,873,829 | A | 10/1989 | Williamson | |
| 5,217,363 | A | 6/1993 | Brais et al. | |
| 5,487,659 | A | 1/1996 | Eroglu et al. | |
| 5,577,386 | A | 11/1996 | Alary et al. | |
| 5,592,819 | A | 1/1997 | Ansart et al. | |
| 5,772,708 | A * | 6/1998 | Froehlich | 48/76 |
| 5,782,032 | A * | 7/1998 | Tanaka et al. | 110/261 |
| 5,785,721 | A | 7/1998 | Brooker | |
| 6,162,266 | A | 12/2000 | Wallace et al. | |
| 6,428,375 | B2 | 8/2002 | Takayanagi | |
| 6,769,242 | B1 | 8/2004 | Balepin | |
| 6,775,984 | B2 | 8/2004 | Lavie et al. | |
| 6,892,654 | B2 * | 5/2005 | Whittaker et al. | 110/260 |
| 7,412,833 | B2 * | 8/2008 | Widener | 60/772 |

FOREIGN PATENT DOCUMENTS

FR 2076 12/1903

OTHER PUBLICATIONS

International Search Report, PCT US2008069411, dated Jan. 29, 2009, pp. 5.

* cited by examiner

*Primary Examiner* — Kenneth Rinehart
*Assistant Examiner* — David J Laux
(74) *Attorney, Agent, or Firm* — Armstrong Teasdale LLP

(57) ABSTRACT

Apparatus for protecting a feed injector and methods of assembly are provided. In one aspect, a method of assembling a feed injector cooling apparatus includes coupling a coolant source in flow communication with a mounting flange, coupling the mounting flange to a first end of a sheath, wherein the sheath circumscribes a feed injector barrel, and coupling a cap to a second end of the sheath, wherein the cap includes a center port through which a feed injector tip projects into a gasifier.

16 Claims, 4 Drawing Sheets

FEED INJECTOR COOLING APPARATUS AND METHOD OF ASSEMBLY

BACKGROUND OF THE INVENTION

This invention relates generally to combined cycle power systems and more specifically, to methods and apparatus for cooling a feed injector.

At least some known combined cycle power systems used for power generation include a gasification system that is integrated with at least one power-producing turbine system. For example, known gasifiers convert a mixture of fuel, air or oxygen, steam, and/or limestone into an output of partially combusted gas, sometimes referred to as "syngas." Hot combustion gases are supplied to the combustor of a gas turbine engine, which powers a generator that supplies electrical power to a power grid. Exhaust from at least some known gas turbine engines is supplied to a heat recovery steam generator that generates steam for driving a steam turbine. Power generated by the steam turbine also drives an electrical generator that provides additional electrical power to the power grid.

At least some known gasification systems use at least one feed injector to supply fuel into a reactor vessel coupled within the gasification system. Known feed injectors are exposed to temperature extremes within the reactor vessel. Specifically, the tips of known feed injectors are exposed to combustion temperatures that may inhibit effective operation of the feed injectors and/or shorten the life span of the feed injectors. Additionally, known feed injectors are also exposed to corrosive elements in the syngas flowing within the reactor vessel. Over time, exposure to such elements may adversely affect the operation and/or shorten the life span of known feed injectors.

To facilitate preventing damage to the feed injectors, at least some known gasification systems use a closed-loop water system to supply cooling water to the feed injector and separate the coolant from the reactor vessel of the gasification system. Generally, such a system includes a heat exchanging apparatus in close proximity to the feed injector. The heat exchange apparatus facilitates recycling water through or near the feed injector such that the water is not allowed to mix with the operational products. However, use of such a system may create a large thermal gradient between the coolant side and the ambient temperature of the injector nozzle, which may induce thermal stresses. Over time, such thermal stresses prematurely shorten the life span of the feed injectors. Other known feed injectors use various alloys to passively prevent the corrosive effects of syngas and its corrosive elements. However, such feed injectors may still be prone to corrosion as a result of carburization, sulfidation, and/or dew point acid attacks.

BRIEF DESCRIPTION OF THE INVENTION

In one aspect, a method of assembling a feed injector cooling apparatus is provided. The method includes coupling a coolant source in flow communication with a mounting flange, coupling the mounting flange to a first end of a sheath, wherein the sheath circumscribes a feed injector barrel, and coupling a cap to a second end of the sheath, wherein the cap includes a center port through which a feed injector tip projects into a gasifier.

In another aspect, an apparatus for protecting a gas injector includes a mounting flange including a coolant port, wherein the mounting flange is coupled in flow communication with a coolant source, a hollow tube including a first end and a second end, wherein the first end is coupled to the mounting flange, and a protective dome coupled to the tube second end.

In a further aspect, a gasifier includes an upper shell and a lower shell coupled to the upper shell such that a cylindrical vessel body is formed therebetween. The cylindrical body includes a combustion zone. At least one feed injector including a nozzle is coupled to the upper shell such that a fuel flowing through the feed injector is discharged through the nozzle into the combustion zone. The gasifier also includes a feed injector cooling assembly including a mounting flange, a sheath, and a domed cap, wherein the sheath includes a first end and a second opposite end, wherein the sheath first end is coupled to the mounting flange and the sheath second end is coupled to the cap.

DETAILED DESCRIPTION OF THE INVENTION

Figure 1:
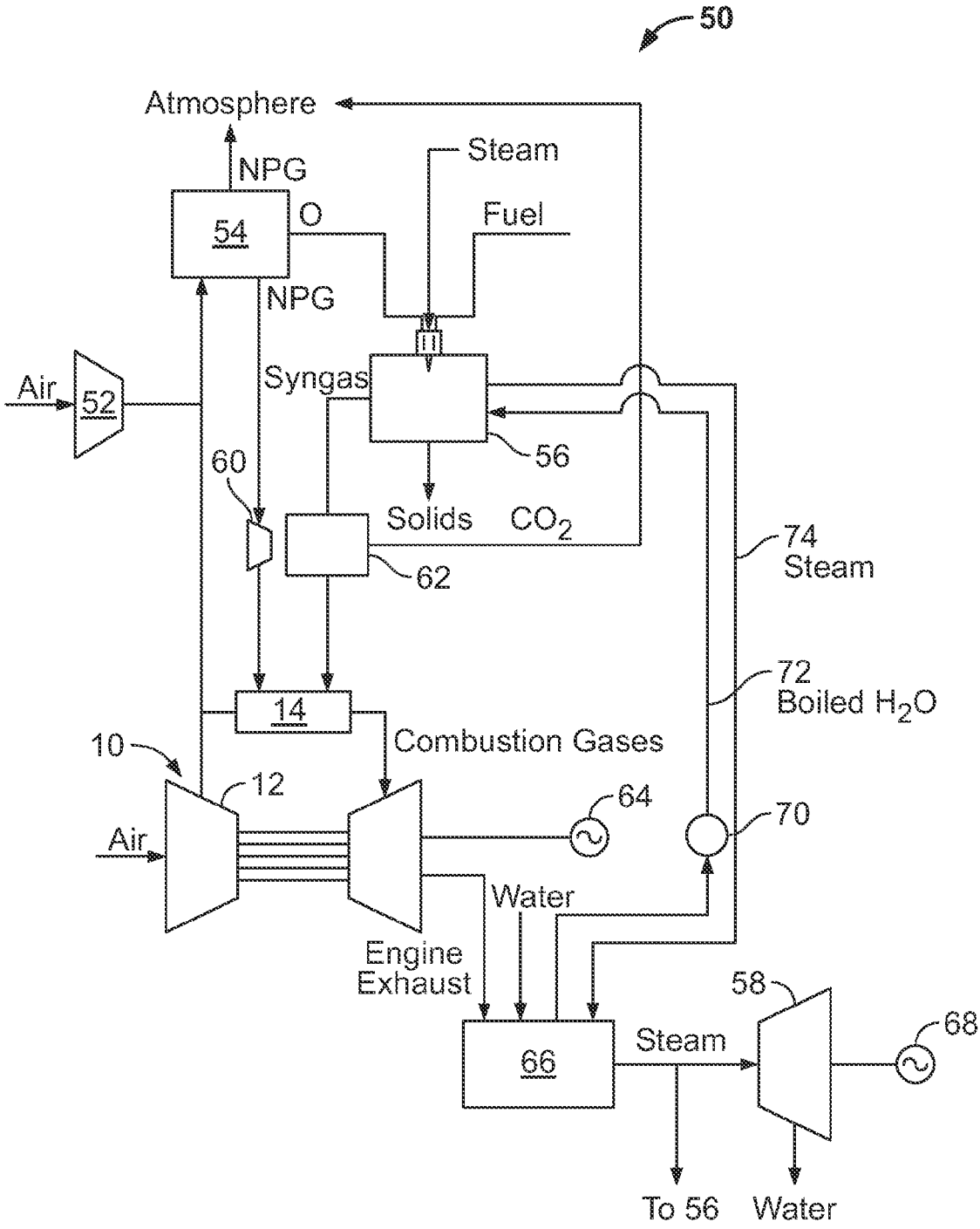
FIG. 1 is a schematic diagram of an exemplary known combined cycle power system.

FIG. 1 is a schematic diagram of an exemplary known combined-cycle power system 50. System 50 generally includes a main air compressor 52, an air separation unit 54 coupled in flow communication to compressor 52, a gasifier 56 coupled in flow communication to air separation unit 54, a gas turbine engine 10, coupled in flow communication to gasifier 56, and a steam turbine 58.

In operation, compressor 52 compresses ambient air that is channeled to air separation unit 54. In some embodiments, in addition to compressor 52 or alternatively, compressed air from gas turbine engine compressor 12 is supplied to air separation unit 54. Air separation unit 54 uses the compressed air to generate oxygen for use by gasifier 56. More specifically, air separation unit 54 separates the compressed air into separate flows of oxygen ($O_2$) and a gas by-product, sometimes referred to as a "process gas". The process gas generated by air separation unit 54 includes nitrogen and will be referred to herein as "nitrogen process gas" (NPG). The NPG may also include other gases such as, but not limited to, oxygen and/or argon. For example, in some embodiments, the NPG includes between about 95% and about 100% nitrogen. The $O_2$ flow is channeled to gasifier 56 for use in generating partially combusted gases, referred to herein as "syngas" for use by gas turbine engine 10 as fuel, as described below in more detail. In some known systems 50, at least some of the NPG flow is vented to the atmosphere from air separation unit 54. Moreover, in some known systems 50, some of the NPG flow is injected into a combustion zone (not shown) within gas turbine engine combustor 14 to facilitate controlling emissions of engine 10, and more specifically to facilitate reducing the combustion temperature and reducing nitrous oxide emissions from engine 10. In the exemplary embodiment, system 50 includes a compressor 60 for compressing the nitrogen process gas flow before being injected into the combustion zone.

Gasifier 56 converts a mixture of fuel, $O_2$ supplied by air separation unit 54, steam, and/or limestone into an output of syngas for use by gas turbine engine 10 as fuel. Although gasifier 56 may use any fuel, in some known systems 50, gasifier 56 uses coal, petroleum coke, residual oil, oil emulsions, tar sands, and/or other similar fuels. In some known systems 50, the syngas generated by gasifier 56 includes carbon dioxide. In the exemplary embodiment, syngas generated by gasifier 52 is cleaned in a clean-up device 62 before being channeled to gas turbine engine combustor 14 for combustion thereof. Carbon dioxide ($CO_2$) may be separated from the syngas during clean-up and, in some known systems 50, may be vented to the atmosphere. Gas turbine engine 10 drives a generator 64 that supplies electrical power to a power grid (not shown). Exhaust gases from gas turbine engine 10 are channeled to a heat recovery steam generator 66 that generates steam for driving steam turbine 58. Power generated by steam turbine 58 drives an electrical generator 68 that provides electrical power to the power grid. In some known systems 50, steam from heat recovery steam generator 66 is supplied to gasifier 56 for generating syngas.

Furthermore, in the exemplary embodiment, system 50 includes a pump 70 that supplies steam 72 from steam generator 66 to a radiant syngas cooler (not shown) within gasifier 56 to facilitate cooling the syngas flowing within gasifier 56. Steam 72 is channeled through the radiant syngas cooler wherein water 72 is converted to steam 74. Steam 74 is then returned to steam generator 66 for use within gasifier 56 or steam turbine 58.

Figure 2:
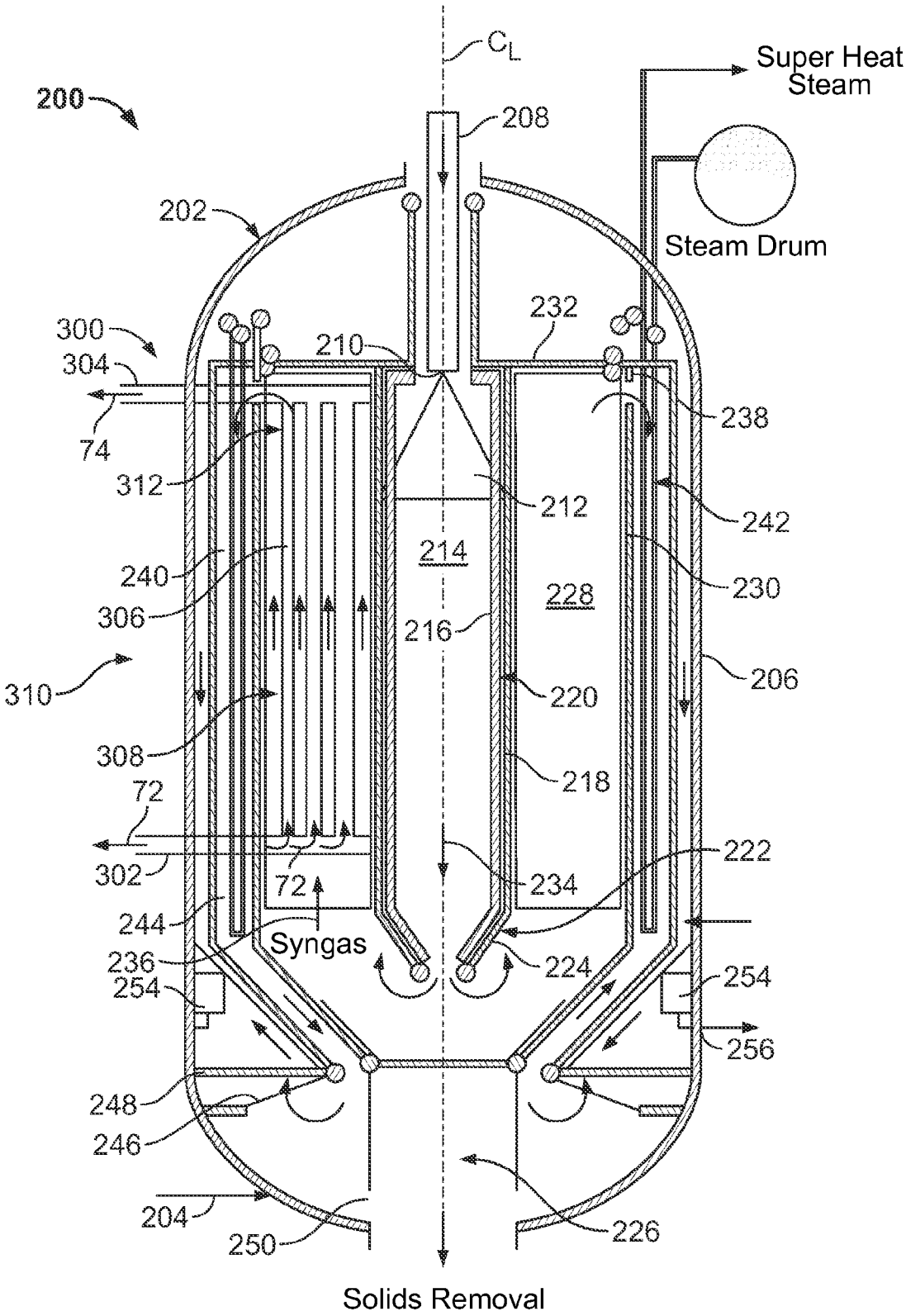
FIG. 2 is a schematic side view of an exemplary gasifier that may be used with the combined cycle power system shown in FIG. 1.

FIG. 2 is a schematic view of an exemplary advanced solids removal gasifier 200 that includes an integral radiant syngas cooler 300. Gasifier 200 may be used with an power system, such as system 50 (shown in FIG. 1). In the exemplary embodiment, gasifier 200 includes an upper shell 202, a lower shell 204, and a substantially cylindrical vessel body 206 extending therebetween. A feed injector 208 penetrates upper shell 202 to enable a flow of fuel to be channeled into gasifier 200. More specifically, the fuel flowing through injector 208 is routed through one or more passages defined in feed injector 208 and is discharged through a nozzle 210 in a predetermined pattern 212 into a combustion zone 214 defined in gasifier 200. The fuel may be mixed with other substances prior to entering nozzle 210, and/or may be mixed with other substances when discharged from nozzle 210. For example, the fuel may be mixed with fines recovered from a process of system 50 prior to entering nozzle 210 and/or the fuel may be mixed with an oxidant, such as air or oxygen, at nozzle 210 or downstream from nozzle 210.

In the exemplary embodiment, combustion zone 214 is defined as a vertically-oriented, generally cylindrical space, that is substantially co-aligned with nozzle 210 in a serial flow communication. An outer periphery of combustion zone 210 is defined by a refractory wall 216 that includes a structural substrate, such as an Incoloy pipe 218 and a refractory coating 220 that substantially resists the effects of high temperatures and high pressures contained within combustion zone 210. In the exemplary embodiment, an outlet end 222 of refractory wall 216 includes a convergent outlet nozzle 224 that facilitates maintaining a predetermined backpressure in combustion zone 214, while permitting products of combustion and syngas generated in combustion zone 214 to exit combustion zone 214. The products of combustion may include gaseous byproducts, slag formed generally on refractory coating 220, and/or fine particular matter carried in suspension with the gaseous byproducts.

After exiting combustion zone 214, flowable slag and solid slag are gravity-fed into a lockhopper 226 coupled to bottom shell 204. Lockhopper 226 is maintained with a level of water that quenches the flowable slag into a brittle solid material that may be broken into smaller pieces when removed from gasifier 200. In the exemplary embodiment, lockhopper 226 captures approximately ninety percent of fine particulate exiting combustion zone 214.

In the exemplary embodiment, an annular passage 228 at least partially surrounds combustion zone 214. Passage 228 is partially defined by refractory wall 216 at an inner periphery, and by a cylindrical shell 230 that is substantially coaxially aligned with combustion zone 214 at a radially outer periphery of first passage 228. First passage 228 is sealed at the top by an upper flange 232. The gaseous byproducts and any remaining fine particulate are channeled from a downward direction 234 in combustion zone 214 to an upward direction 236 in passage 228. The rapid redirection at outlet nozzle 224 facilitates separating fine particulate and slag separation from gaseous byproducts.

The gaseous byproducts and any remaining fine particulate are channeled upward through passage 228 to an outlet 238. As the gaseous byproducts are channeled through passage 228, heat may be recovered from the gaseous byproducts and the fine particulate. For example, in one embodiment, the gaseous byproducts enter passage 228 at a temperature of approximately 2500° Fahrenheit and exit passage 228 at a temperature of approximately 1800° Fahrenheit. The gaseous byproducts and fine particulates are discharged from passage 228 through outlet 238 and are channeled into a second annular passage 240 wherein the gaseous byproducts and fine particulates are redirected to a downward flow direction 241. As gaseous byproducts and fine particulates flow through passage 240, heat may be recovered using for example, superheat tubes 242 that transfer heat from the flow of gaseous byproducts and the fine particulates to steam flowing through superheat tubes 242. For example, in one embodiment, the gaseous byproducts enter passage 240 at a temperature of approximately 1800° Fahrenheit and exit passage 240 at a temperature of approximately 1500° Fahrenheit.

When the flow of gaseous byproducts and the fine particulates reach a bottom end 244 of passage 240, passage 240 converges toward lockhopper 226. More specifically, at bottom end 244, the flow of gaseous byproducts and the fine particulates is channeled upward through a water spray 246 that desuperheats the flow of gaseous byproducts and the fine particulates. Heat removed from the flow of gaseous byproducts and the fine particulates tends to vaporize water spray 246 and agglomerate the fine particulates such that the fine particulates form a relatively larger ash clod that falls into lower shell 204. The flow of gaseous byproducts and the remaining fine particulates are channeled in a reverse direction towards a perforated plate 248 that circumscribes bottom end 244. A level of water is maintained above perforated plate 248 to facilitate removing additional fine particulate from the flow of gaseous byproducts. As the flow of gaseous byproducts and the remaining fine particulates percolate through perforated plate 248, fine particulates contained in the flow are entrapped in the water and carried through the perforations into a sump formed in bottom shell 204. A gap 250 defined between lockhopper 226 and bottom shell 204 enables the fine particulates to flow into lockhopper 226 wherein the fine particulates are facilitated to be removed from gasifier 200.

An entrainment separator 254 encircles an upper end of lower shell 204. More specifically, separator 254 is above perforated plate 248 and above the level of water covering perforated plate 248. Entrainment separator 254 may be for example, a cyclonic or centrifugal separator that includes a tangential inlet or turning vanes that impart a swirling motion to the gaseous byproducts and the remaining fine particulates flowing therethrough. The particulates are thrown outward by centrifugal force to the walls of separator 254 wherein the fine particulates coalesce and are gravity-fed to the separator bottom shell 204. Additionally, any remaining fine particulates impact a mesh pad, agglomerate with other particulates and are flushed to bottom shell 204.

Alternatively, entrainment separator 254 can be of a blade type, such as a chevron separator or an impingement separator. In a chevron separator, the gaseous byproducts pass between blades and are forced to travel in a tortuous or zigzag pattern. The entrained particulates and any liquid droplets cannot follow the gas streamlines, and impinge against the blade surfaces prior to coalescing, wherein the particulates are gravity-fed into bottom shell 204. Features such as hooks and pockets, can be added to the sides of the blades to facilitate improving particulate and liquid droplet capture. In addition, chevron grids can be stacked to provide a series of separation stages. Similarly, impingement separators create a cyclonic motion as gaseous byproducts and fine particulates pass over curved blades. A spinning motion is imparted that causes the entrained particulates and any liquid droplets to be forced against to the vessel walls, wherein the entrained particulates and any liquid droplets may be collected in bottom shell 204.

The flow of gaseous byproducts and any remaining fine particulates enter separator 254 wherein substantially all of any remaining entrained particulate and/or liquid droplets are removed form the flow of gaseous byproducts. The flow of gaseous byproducts exits gasifier 200 through an outlet 256 for further processing.

In the exemplary embodiment, gasifier 200 also includes a radiant syngas cooler 300 that is coupled within passage 228. In the exemplary embodiment, cooler 300 includes an inlet 302, an outlet 304, and a plurality of cooling tubes 306 that extend therebetween. Cooling tube 306 is positioned within passage 228 to facilitate cooling syngas flowing through passage 228. Moreover, in the exemplary embodiment, cooler 300 is a three-pass cooler that includes three cooling tubes 306. In an alternative embodiment, cooler 300 may include any suitable number of cooling tubes 306 that facilitate cooling the syngas in passage 228. Moreover, in one embodiment, cooler 300 includes a plurality of cooling tubes 306 spaced circumferentially about a centerline CL of cylindrical vessel 206.

In the exemplary embodiment, inlet 302 extends from a first end 308 of cooling tube 306 to an exterior 310 of cylindrical vessel 206. Similarly, outlet 304 extends from a second end 312 of cooling tube 306 to exterior 310. In the exemplary embodiment, inlet 302 is positioned below outlet 304. In an alternative embodiment, inlet 302 is positioned above outlet 304 or substantially planar therewith.

During operation, pump 70 channels steam 72 from steam generator 66 through inlet 302 and into cooling tube first end 308. Alternatively, steam 72 may be channeled to inlet 302 from any suitable source. Steam 72 is then channeled through cooling tube 306 towards second end 312. Simultaneously, syngas channeled through passage 228 flows around cooling tube 306 to facilitate a heat exchange between the syngas and steam 72. Specifically, because steam 72 has a temperature that is less than the temperature of the syngas, steam 72 absorbs heat from the syngas to facilitate cooling the syngas.

Furthermore, in addition to cooling the syngas, cooling tube 306 facilitates cooling of refractory wall 216. More specifically, as steam 72 absorbs heat from the syngas, a higher temperature steam 74 is produced in cooling tube 306 and is discharged through outlet 304. In the exemplary embodiment, steam 74 is discharged from outlet 304 to steam generator 66 for further use within system 50. In an alternative embodiment, steam 74 is channeled to any suitable portion of system 50 and/or any other system that requires steam. In another alternative embodiment, steam 74 is discharged from system 50 to the atmosphere.

Figure 3:
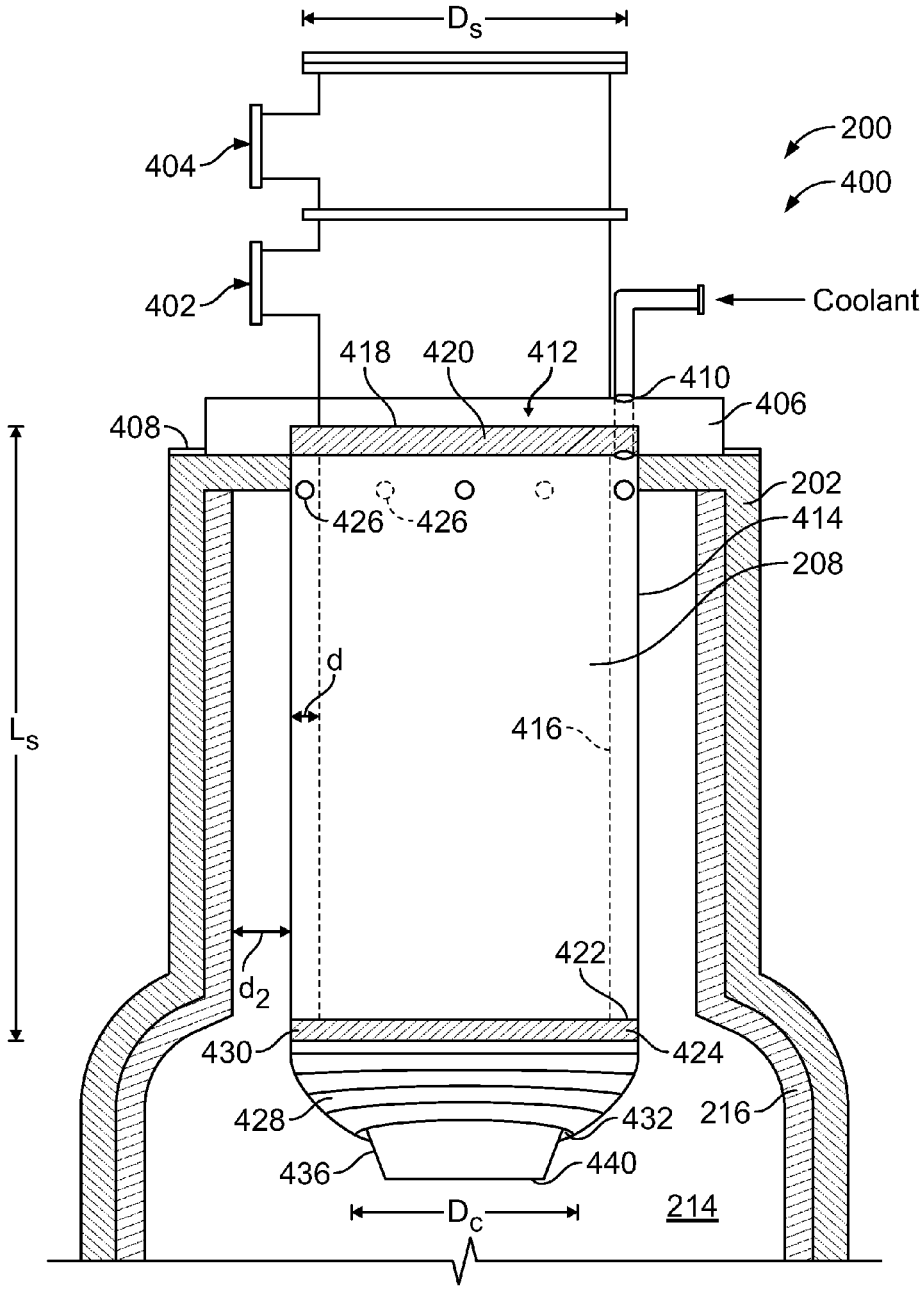
FIG. 3 is a side view of an exemplary feed injector cooling apparatus that may be used with the gasifier shown in FIG. 2.

FIG. 3 is a side view of an exemplary feed injector cooling apparatus 400 that may be used with a gasifier, such as gasifier 200 having at least one feed injector, such as feed injector 208. Specifically, FIG. 3 shows a side view of a combustion zone 214 gasifier 200 including feed injector 208. Gasifier 200 includes upper shell, such as upper shell 202 and a refractory wall, such as refractory wall 216 coupled to an inside surface of upper shell 202. Feed injector 208 is coupled in flow communication with a fuel stream 402 and an oxygen stream 404 to facilitate mixing the fuel and oxygen components in reaction zone 214.

Moreover, FIG. 3 shows an exemplary feed injector cooling apparatus 400. Apparatus 400 includes a mounting flange 406 coupled to a gasifier top seal 408. In the exemplary embodiment, flange 406 is coupled to top seal 408 using a ring-type joint (not shown). Alternative embodiments may use other available means for coupling flange 406 to top seal 408. Mounting flange 406 includes a coolant port 410 coupled in flow communication to a coolant source (not shown). In the exemplary embodiment, the coolant is a gas composed of at least one of carbon dioxide, nitrogen, and steam. In an alternative embodiment, the coolant is a gas composed of a combination of carbon dioxide, nitrogen, and/or steam. Further alternative embodiments may use various other gases and combinations of gases. In the exemplary embodiment, flange 406 is composed of a metal to facilitate resisting corrosion from contact with a syngas. In alternative embodiments, flange 406 may be composed of a different material that enables flange 406 to resist corrosion from contact with a syngas. Flange 406 also includes a threaded opening 412.

Apparatus 400 also includes a sheath 414 that circumscribes a barrel 416 of feed injector 208. Sheath 414 includes a first end 418 that includes a first threaded fastener 420. Flange opening 412 is sized to receive first fastener 420 to facilitate coupling sheath 414 to flange 406. First fastener 420 and flange opening 412 are threaded to facilitate assembling apparatus 400. Moreover, first fastener 420 and flange opening 412 are threaded to facilitate replacing damaged or failed components, such as flange 406 and/or sheath 414. Sheath 414 also includes a second end 422 that includes a second threaded fastener 424. Sheath 414 also includes a plurality of gas ports 426 positioned equidistantly around sheath 414. In the exemplary embodiment, ports 426 are located at sheath first end 418. In the exemplary embodiment, sheath 414 is composed of a metal to facilitate resisting corrosion from contact with a syngas. In alternative embodiments, sheath 414 may be composed of a different material that enables sheath 414 to resist corrosion from contact with a syngas. In the exemplary embodiment, sheath 414 includes a length, $L_s$, measuring between 25 and 45 inches and, more specifically, between 30 and 40 inches. Sheath 414 also includes a diameter, $D_s$, measuring between 3 and 15 inches and, more specifically, between 6 and 12 inches. Additionally, the distance, d, between feed injector barrel 416 and sheath 414 measures between ¼ and 1¾ inches and, more specifically, between ½ and 1½ inches. Alternative embodiments may include different sheath dimensions, $D_s$ and $L_s$, and distance, d, between sheath 414 and feed injector barrel 416.

In the exemplary embodiment, apparatus 400 also includes a cap 428. Cap 428 includes a threaded opening 430 sized to receive second fastener 424 of sheath 414. Second fastener 424 and cap opening 430 are threaded to facilitate assembling apparatus 400. Moreover, second fastener 424 and cap opening 430 are threaded to facilitate replacing damaged or failed components, such as sheath 414 and/or cap 428. Cap 428 also includes a center port 432. In the exemplary embodiment, center port 432 includes a diameter, $D_c$, of between 1 and 6 inches and, more specifically, between ½ and 5 inches. Alternative embodiments may include a different port diameter, $D_c$.

Figure 4:
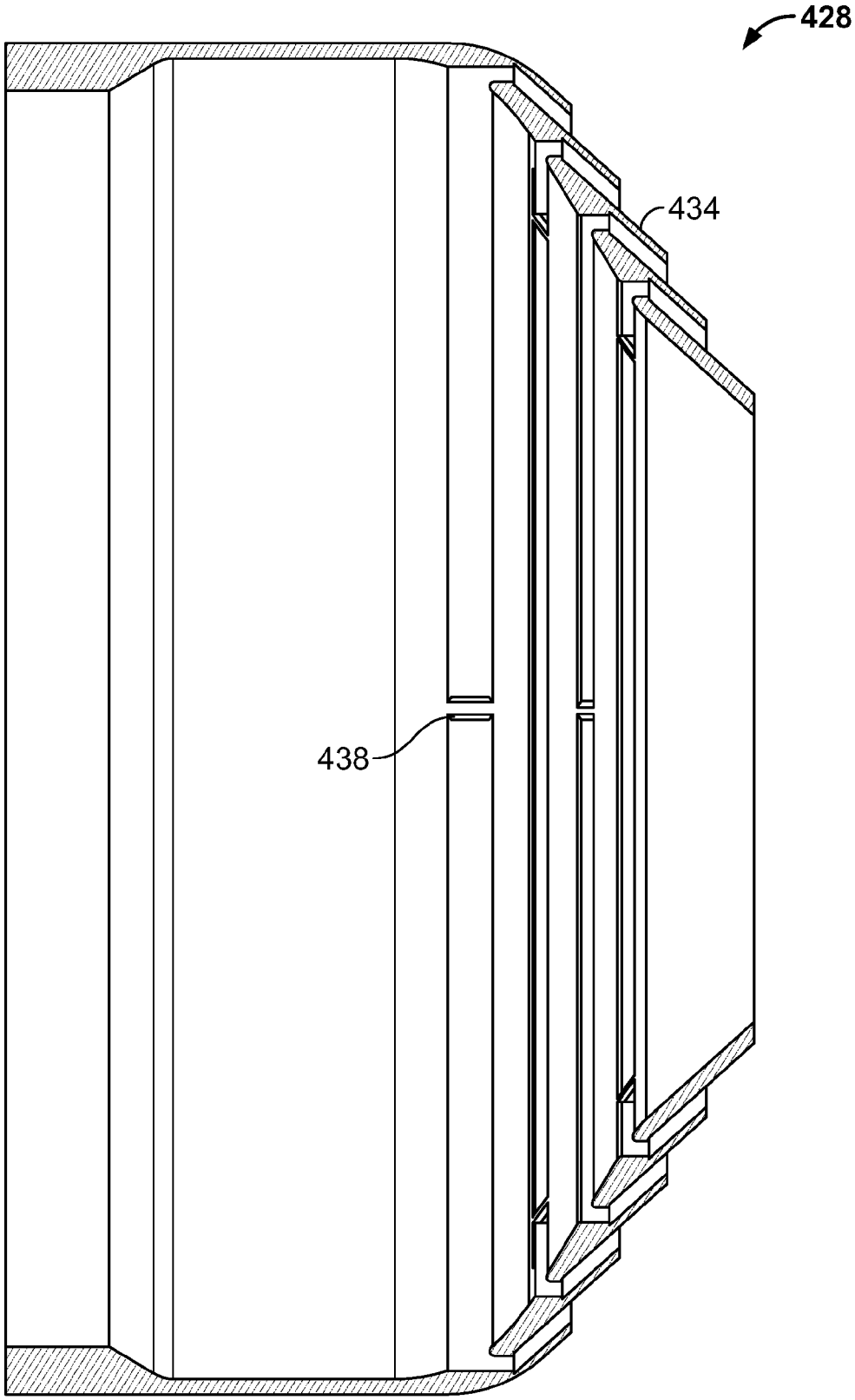
FIG. 4 is a cross-sectional view of an exemplary cap used that may be used with the feed injector cooling apparatus shown in FIG. 3.

Moreover, and as further shown in FIG. 4, cap 428 also includes a plurality of overlapping annuli 434. Center port 432 is located at the center of annuli 434 such that a tip 436 of feed injector 208 passes through center port 432 and into combustion zone 214. Cap 428 also includes a plurality of struts 438 coupled to annuli 434 to facilitate supporting cap 428. In the exemplary embodiment, annuli 434 are each separate sections and are coupled together using struts 438. In an alternative embodiment, annuli 434 are formed from a single piece. In the exemplary embodiment, cap 428 is composed of a metal to facilitate resisting corrosion from contact with a syngas. In alternative embodiments, cap 428 may be composed of a different material that enables cap 428 to resist corrosion from contact with a syngas.

During operation, oxygen 404 and fuel 402 flow through feed injector 208 into combustion zone 214 of gasifier 200. In combustion zone 214, a face 440 of feed injector 208 is subjected to extremely high temperatures. Moreover, face 440 is exposed to corrosive syngas which, in time, can lead to corrosion and failure of feed injector 208. To facilitate protecting face 440 from the high temperatures, a coolant gas flows from coolant source (not shown), through mounting flange 406, and into a cavity defined by distance, d, between feed injector barrel 416 and sheath 414. The coolant gas flows from sheath first end 418 toward cap 428 coupled to sheath second end 422. Annuli 434 of cap 428 force the coolant gas radially inward towards cap center port 432. As the coolant gas exits cap center port 432, it forms a thin film across feed injector face 440, thereby protecting face 440 from the high temperatures of combustion zone 214.

Further, during operation, syngas flows from combustion zone 214 towards sheath first end 418, exposing feed injector barrel 416 to the corrosive elements of syngas which, in time, can lead to corrosion and failure of feed injector 208. Gas ports 426 positioned around sheath first end 418 facilitate purging the cavity defined by the distance, d, between feed injector barrel 416 and sheath 414 of syngas. As the coolant gas flows into sheath first end 418, it forces coolant gas to exit via gas ports 426 and sheath second end 422 simultaneously. As the coolant gas exits gas ports 426 it flows along sheath 414, thereby purging a cavity defined by the distance, $d_2$.

The above-described method and apparatus facilitate improving the life span of a feed injector as used in a gasifier. Purging the syngas and its corrosive elements facilitates preventing corrosion of the feed injector by purging the shielding barrel cavity with a relatively inert gas. Moreover, producing a thin film of gas across the center port of the cap facilitates protecting the face of the feed injector from exposure to high reactor vessel temperatures and from the large thermal gradient created by a closed water coolant system. Further, the modular construction of the apparatus facilitates easy replacement of the components such as the shielding barrel or cap. Quickly replacing such components in the field rather than sending the entire feed injector assembly to a qualified repair shop facilitates allowing greater online time of the power system.

Exemplary embodiments of methods and apparatus that facilitate cooling a feed injector are described above in detail. The methods and apparatus are not limited to the specific embodiments described herein, but rather, components of the methods and apparatus may be utilized independently and separately from the other components described herein. For example, the shielding barrel may also be used in combination with other industrial plant or component cooling systems and methods, and is not limited to practice with only power systems as described herein. Rather, the present invention can be implemented and utilized in connection with many other component or plant designs and monitoring applications.

While the invention has been described in terms of various specific embodiments, those skilled in the art will recognize that the invention can be practiced with modification within the spirit and scope of the claims.

What is claimed is:

1. An apparatus for protecting a gas injector that is at least partially positioned within a gasifier, said apparatus comprising:

a mounting flange coupled to a top end of the gasifier, said mounting flange comprising a coolant port coupled in flow communication with a coolant source;

a hollow tube extending outwardly from said mounting flange into a combustion zone defined in the gasifier, said hollow tube extending between a first end and a second end and circumscribing the gas injector such that a cavity is defined between said hollow tube and the gas injector, said first end coupled to said mounting flange such that said coolant port is in flow communication with said cavity, said hollow tube including a plurality of ports positioned at said tube first end, said ports extending through said tube and coupling said cavity in flow communication with the gasifier combustion zone; and a protective dome coupled to said tube second end, said protective dome defining a first opening sized to receive a portion of the gas injector therein, said first opening coupling said cavity in flow communication with the gasifier combustion zone.

2. An apparatus in accordance with claim 1 wherein said tube first and second ends each comprise a threaded fastener.

3. An apparatus in accordance with claim 2 wherein said mounting flange further comprises a threaded opening sized to receive said tube first end threaded fastener.

4. An apparatus in accordance with claim 2 wherein said dome comprises a second threaded opening sized to receive said tube second end threaded fastener.

5. An apparatus in accordance with claim 1 wherein said dome comprises a plurality of overlapping rings and a center port.

6. An apparatus in accordance with claim 5 wherein said dome further comprises a plurality of supporting structures coupling each ring of said plurality of overlapping rings.

7. A gasifier comprising:

an upper shell;

a lower shell coupled to said upper shell such that a cylindrical vessel body is formed therebetween, said cylindrical body comprising a combustion zone;

at least one feed injector comprising a nozzle, said feed injector coupled to said upper shell such that a fuel flowing through said feed injector is discharged through said nozzle into said combustion zone; and a feed injector cooling assembly comprising a mounting flange coupled to said upper shell and comprising a cooling port coupled in flow communication with a cooling source, a sheath extending outwardly from said mounting flange into said combustion zone, and a domed cap, said sheath extends between a first end and a second opposite end and circumscribes said feed injector such that a cavity is defined between said sheath and said feed injector, said sheath first end coupled to said mounting flange such that said cooling port is in flow communication with said cavity, said domed cap coupled to said sheath second end and comprising an opening defined therein, said sheath including a plurality of ports extending therethrough, said sheath cavity in flow communication with said combustion zone via said cap opening and said plurality of ports, wherein said plurality of ports are positioned at said sheath first end to facilitate purging said sheath cavity of a syngas.

8. A gasifier in accordance with claim 7 wherein said mounting flange comprises a threaded opening sized to receive a threaded fastener of said sheath first end.

9. A gasifier in accordance with claim 7 wherein said cap comprises:

a plurality of overlapping annuli;

a port at the center of said annuli, said port sized to allow said feed injector to project into said combustion zone; and a threaded opening sized to receive a threaded fastener of said sheath second end.

10. A gasifier in accordance with claim 9 wherein said cap comprises a plurality of struts configured to support said annuli.

11. A method of assembling a feed injector cooling apparatus, said method comprising:

coupling a coolant source in flow communication with a mounting flange;

coupling the mounting flange to a first end of a sheath, wherein the sheath circumscribes and is spaced radially outward from a feed injector barrel such that a cavity is defined between the sheath and the feed injector barrel, wherein the cavity is coupled in flow communication with the coolant source, wherein the sheath includes a plurality of ports extending through the sheath; and coupling a cap to a second end of the sheath, wherein the cap includes a center port through which a feed injector tip projects into a combustion zone defined in a gasifier such that the sheath cavity is coupled in flow communication with the gasifier combustion zone via the center port and the plurality of ports.

12. A method in accordance with claim 11 wherein coupling a coolant source in flow communication with a mounting flange comprises coupling the coolant source to a coolant port extending through the mounting flange to facilitate channeling coolant into the sheath.

13. A method in accordance with claim 11 wherein coupling the mounting flange to the first end of a sheath comprises inserting a threaded fastener of the sheath first end into a threaded opening of the mounting flange.

14. A method in accordance with claim 11 wherein coupling a cap to the second end of the sheath comprises inserting a threaded fastener of the sheath second end into a threaded opening of the cap.

15. A method in accordance with claim 14 wherein coupling a cap to the second end of the sheath further comprises coupling a cap to the second end of the sheath, wherein the cap includes a plurality of overlapping annuli.

16. A method in accordance with claim 15 wherein coupling a cap to the second end of the sheath further comprises coupling a cap to the second end of the sheath, wherein the cap further includes a plurality of struts supporting the annuli.

* * * * *